US006712281B2

(12) United States Patent
Hirota et al.

(10) Patent No.: US 6,712,281 B2
(45) Date of Patent: Mar. 30, 2004

(54) EXPANSION VALVE

(75) Inventors: Hisatoshi Hirota, Hachioji (JP); Takeshi Kaneko, Hachioji (JP)

(73) Assignee: TGK Co. Ltd. (JP)

( * ) Notice: Subject to any disclaimer, the term of this patent is extended or adjusted under 35 U.S.C. 154(b) by 0 days.

(21) Appl. No.: 10/279,503

(22) Filed: Oct. 24, 2002

(65) Prior Publication Data

US 2003/0079493 A1 May 1, 2003

(30) Foreign Application Priority Data

Oct. 30, 2001 (JP) ..... 2001-332094

(51) Int. Cl.[7] ..... F25B 43/00; G05D 27/00
(52) U.S. Cl. ..... 236/92 B; 62/474
(58) Field of Search ..... 62/225, 474; 236/92 B

(56) References Cited

U.S. PATENT DOCUMENTS 4,015,776 A * 4/1977 Orth et al. ..... 236/92 B
4,095,742 A * 6/1978 Schumacher ..... 236/92 B
5,232,015 A * 8/1993 Heffner et al. ..... 137/549
5,238,219 A * 8/1993 Noelke et al. ..... 251/61.3
5,364,066 A * 11/1994 Dorste et al. ..... 251/122
6,015,928 A * 1/2000 Gubisch et al. ..... 568/882
6,148,631 A * 11/2000 Watanabe et al. ..... 62/296
6,520,419 B2 * 2/2003 Hirota et al. ..... 236/92 B

FOREIGN PATENT DOCUMENTS

| | | |
|---|---|---|
| EP | 1 106 819 A2 | 6/2001 |
| JP | 05023508 | 2/1993 |
| JP | 2000241048 | 9/2000 |
| JP | 2001116402 | 4/2001 |

* cited by examiner

*Primary Examiner*—William E. Tapolcai
(74) *Attorney, Agent, or Firm*—Patterson, Thuente, Skaar & Christensen, P.A.

(57) ABSTRACT

To provide a low-cost block-type expansion valve containing a strainer. A block-type expansion valve is configured such that a hollow cylindrical strainer is arranged in a space for introducing high-pressure liquid refrigerant, in a manner surrounding a valve element, and the refrigerant introduced into a refrigerant pipe-connecting hole is permitted to flow into a space on the upstream side of the valve element 17 via the strainer. Therefore, since the shape of a body is not substantially changed, it is possible to provide the expansion valve at low costs by suppressing an increase in the manufacturing costs to the cost of the strainer.

2 Claims, 3 Drawing Sheets

EXPANSION VALVE

BACKGROUND OF THE INVENTION (1) Field of the Invention

This invention relates to an expansion valve, and more particularly to a block-type expansion valve which is employed as an expansion device in a rear-side part of the system of a so-called dual air conditioner for an automotive vehicle, which uses an orifice tube in a front-side part thereof.

(2) Description of the Related Art

Conventionally, as the system of the automotive dual air conditioner, there are known one which uses an orifice tube as a front-side expansion device, and one which uses an expansion valve as the same. Both of the systems use an expansion valve as a rear-side expansion device.

In the system which uses an orifice tube as the front-side expansion device, refrigerant compressed by a compressor is condensed by a condenser, and liquid refrigerant formed by complete condensation by the condenser is expanded in the orifice tube, evaporated by an evaporator, and caused to undergo gas/liquid separation by an accumulator. Gaseous refrigerant obtained by the separation is returned to the compressor.

On the other hand, in the system which uses an expansion valve as the front-side expansion device, refrigerant compressed by a compressor is condensed by a condenser, the condensed refrigerant is caused to undergo gas/liquid separation by a receiver/dryer, and liquid refrigerant obtained by the gas/liquid separation is expanded by the expansion valve, and completely evaporated by an evaporator, followed by returning to the compressor.

In general, the receiver/dryer not only separates gaseous refrigerant from liquid refrigerant and removes moisture but also clears foreign matter from the refrigerant circulating through the system with a strainer incorporated therein. Therefore, the refrigerant having passed through the receiver/dryer is sent into the front-side expansion valve in a state cleared of foreign matter. At this time, liquid refrigerant cleared of foreign matter by the receiver/dryer is also supplied to the rear-side expansion valve.

On the other hand, in the system which uses the orifice tube as the front-side expansion device, the liquid refrigerant delivered from the condenser is directly supplied to the front-side orifice tube and the rear-side expansion valve. Since the orifice tube is configured to incorporate the strainer as an integral part thereof, foreign matter in the refrigerant is removed on the inlet side of the orifice tube. However, for the rear-side expansion valve, since the refrigerant containing foreign matter is directly supplied thereto, a strainer is usually arranged in a pipe on the upstream side of the valve.

To incorporate the strainer in the pipe, the pipe needs being formed into a specific shape and increased man-hours are necessary for the assembly work, resulting in an increase in manufacturing costs. On the other hand, some of the conventional expansion valves contain a strainer and make it unnecessary to incorporate the strainer in the pipe.

The above strainer-containing expansion valve is called a joint connection-type or angle-type expansion valve, which includes connecting portions for connecting thereto a pipe extending from a condenser and a pipe leading to an evaporator. According to this type of valve, only the connecting portions can be lengthened with ease, and therefore the strainer can be inserted into an inlet-side connecting portion, by lengthening the same.

However, when the so-called box-type or block-type expansion valve is used as the rear-side expansion valve, it is necessary to incorporate a strainer in a pipe on the upstream side of the valve. More specifically, in the block-type expansion valve, the pipe is inserted to an intermediate portion of an inlet-side port, and there is no space for mounting the strainer in the port. Therefore, if the strainer is desired to be attached to the inlet-side port, it is necessary to extend an end of the body on a high-pressure refrigerant inlet side to make a hole of the port deep enough to mount the strainer at an inner portion of the hole. This increase in length and size of the body only for arranging the strainer therein results in an increase in the material cost and working cost of the body besides an additional cost of the strainer, which further increase the manufacturing costs of the expansion valve. To avoid such an disadvantage, it is necessary to incorporate the strainer in the pipe separately from the valve.

SUMMARY OF THE INVENTION

The present invention has been made in view of the above circumstances, and an object thereof is to provide a low-cost block-type expansion valve containing a strainer.

To solve the above problem, the present invention provides an expansion valve of a block type including a power element for sensing a temperature and pressure of refrigerant delivered from an evaporator, and a valve portion containing a valve element in a block-shaped body thereof, characterized by comprising a hollow cylindrical strainer which is mounted in a fluid passage having said valve element arranged therein, in a manner surrounding said valve element.

According to this expansion valve, the strainer is configured to be mounted in a space of a refrigerant passage having the valve element arranged therein. Since the refrigerant passage is an existing one, it is possible to maintain the present costs of parts except for the cost of the strainer.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 3 is a diagrams showing an example of a strainer, in which:

(A) is a plan view of the strainer;

(B) is a cross-sectional view of the strainer taken on line a—a of (A); and (C) is a cross-sectional view of the strainer taken on line b—b of (B).

DESCRIPTION OF THE PREFERRED EMBODIMENTS

Hereinafter, an embodiment of the present invention will be described in detail with reference to the drawings. In the embodiment, an expansion valve according to the invention is applied to a rear-side expansion device for an automotive dual air conditioner, by way of example.

Figure 1:
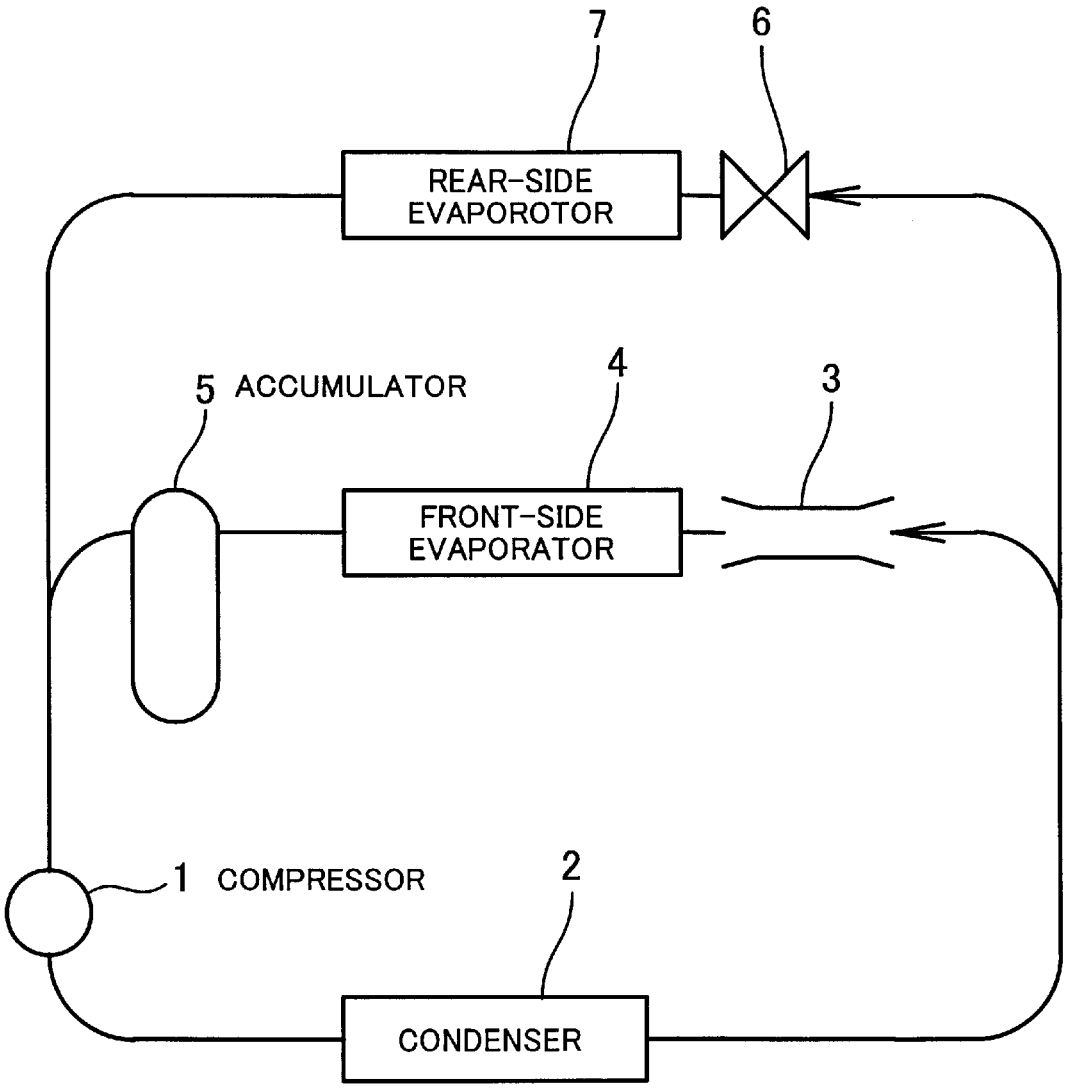
FIG. 1 is a system diagram showing a dual air conditioner to which is applied an expansion valve according to the invention.

FIG. 1 is a system diagram of a dual air conditioner to which is applied the expansion valve according to the invention.

The automotive dual air conditioner to which is applied the expansion valve according to the invention includes a compressor 1, a condenser 2, an orifice tube 3, a front-side evaporator 4, and an accumulator 5, which form a refrigeration cycle for a front-side air conditioner, as well as a temperature-type expansion valve 6 and a rear-side evaporator 7 which are connected in parallel with a circuit of the orifice tube 3, the front-side evaporator 4, and the accumulator 5, and form part of a refrigeration cycle for a rear-side air conditioner.

Refrigerant compressed by the compressor 1 is condensed by the condenser 2. Part of the liquid refrigerant formed by the condensation is guided into the orifice tube 3, and the remainder of the same is guided to the expansion valve 6.

The refrigerant guided into the orifice tube 3 is subjected to throttle expansion therein to be changed into low-temperature and low-pressure refrigerant which is then caused to exchange heat with front-side cabin air by the front-side evaporator 4. The refrigerant evaporated through the heat exchange by the front-side evaporator 4 is caused to undergo gas/liquid separation by the accumulator 5 and gaseous refrigerant obtained by the separation is returned to the compressor 1.

On the rear side, the refrigerant guided into the expansion valve 6 is subjected to throttle expansion according to the temperature and pressure of the refrigerant delivered from the rear-side evaporator 7, to be changed into low-temperature and low-pressure refrigerant, which is then guided into the rear-side evaporator 7 to exchange heat with rear-side cabin air. In the rear-side evaporator 7, the refrigerant is completely evaporated through the heat exchange, followed by returning to the compressor 1.

Next, the expansion valve 6 according to the present invention, which is used as the rear-side air conditioner expansion device, will be described in detail.

Figure 2:
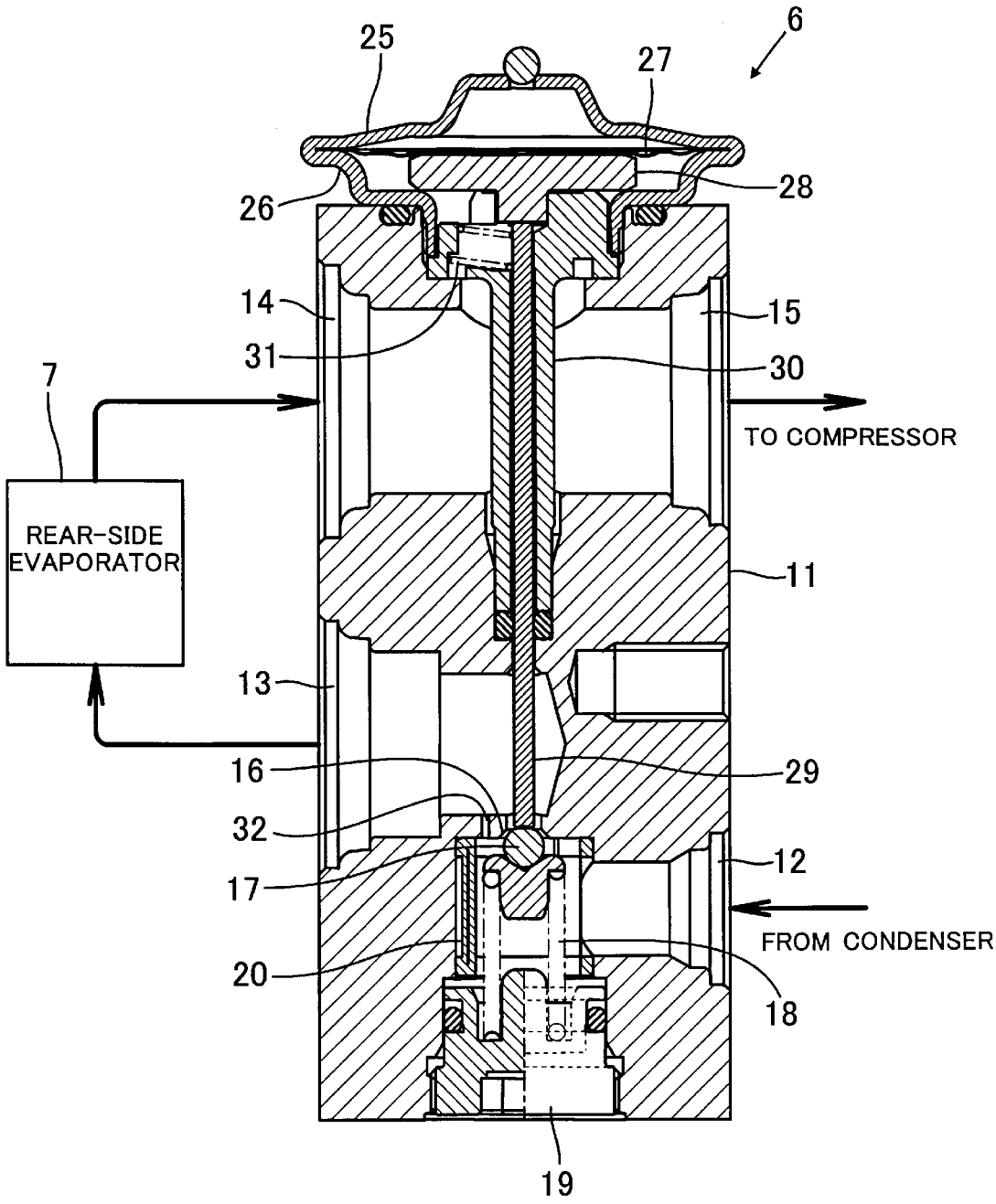
FIG. 2 is a longitudinal sectional view showing the construction of the expansion valve according to the invention.
Figure 3A:
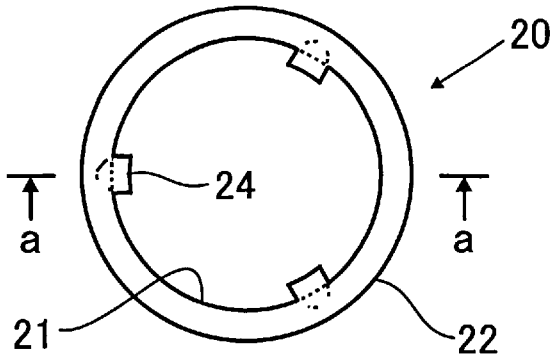
Figure 3B:
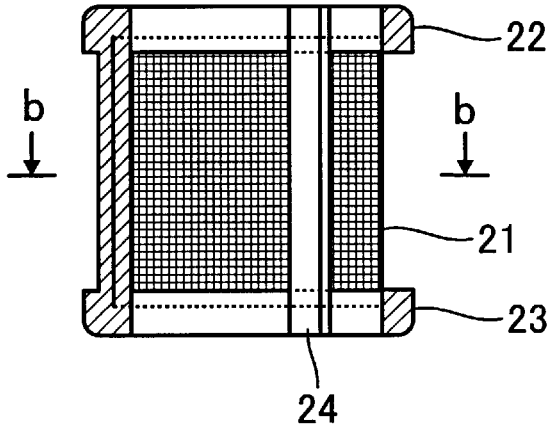
Figure 3C:
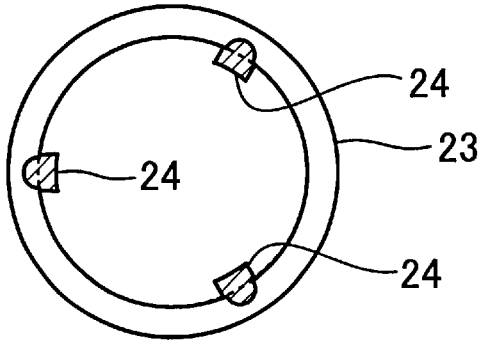

FIG. 2 is a longitudinal sectional view showing the construction of the expansion valve according to the invention. FIG. 3 provides diagrams showing an example of the strainer, in which (A) is a plan view of the strainer, (B) is a cross-sectional view of the same taken on line a—a of (A), and (C) is a cross-sectional view of the same taken on line b—b of (B).

In the expansion valve 6, a refrigerant pipe-connecting hole 12 formed through a side portion of a body 11 of the expansion valve 6 is connected to a refrigerant pipe through which high-temperature and high-pressure refrigerant is supplied from the condenser 2, a refrigerant pipe-connecting hole 13 is connected to a refrigerant pipe for supplying low-temperature and low-pressure refrigerant obtained by adiabatically expanding the high-temperature and high-pressure refrigerant by the expansion valve 6 to the rear-side evaporator 7, a refrigerant pipe-connecting hole 14 is connected to a refrigerant pipe extending from an outlet port of the evaporator, and a refrigerant pipe-connecting hole 15 is connected to a refrigerant pipe leading to the compressor 1. Arrows shown in FIG. 2 indicate flows of refrigerant, respectively.

In a fluid passage communicating between the refrigerant pipe-connecting hole 12 and the refrigerant pipe-connecting hole 13, a valve seat 16 is integrally formed with the body 11, and on the upstream side of the valve seat 16 is arranged a ball valve element 17. In a fluid passage on the side of the refrigerant pipe-connecting hole 12 is arranged a compression coil spring 18 for urging the valve element 17 in a direction of seating the valve element 17 on the valve seat 16. The compression coil spring 18 is received by an adjusting screw 19. The adjusting screw 19 is screwed into a lower end of the body 11 and has a function of adjusting a preset value of pressure at which the valve element 17 starts to be opened, by having the amount of screwing thereof adjusted to change the load on the compression coil spring 18. In the fluid passage accommodating the valve element 17 and the compression coil spring 18, the strainer 20 having a hollow cylindrical shape is arranged in a manner surrounding the valve element 17 and the compression coil spring 18.

As shown in FIG. 3, the strainer 20 is comprised of a hollow cylindrical net 21, annular frames 22, 23 for reinforcing both open ends of the net 21, and longitudinal frames 24 for connecting the frames 22, 23 thereby at respective three locations. The net 21 is held by the frames 24 in a state buried thereunder. The frames 22, 23, 24 are integrally formed with each other by molding using a resin. Each of the annular frames 22, 23 is formed such that it has an outer diameter approximately equal to the inner diameter of the fluid passage in which the strainer 20 is mounted, and hence the frames 22, 23 are arranged in contact with the body 11 when the strainer 20 is mounted in the fluid passage. On the other hand, the net 21 has an outer diameter smaller than the inner diameter of the fluid passage so as to form a gap between the same and the inner wall of the fluid passage. This permits the refrigerant flowing from the refrigerant pipe-connecting hole 12 to flow into a space accommodating the valve element 17 through the net 21 from a whole periphery thereof.

The expansion valve 6 further includes a power element arranged on an upper end of the body 11, which is comprised of an upper housing 25, a lower housing 26, a diaphragm 27 for dividing a space enclosed by the upper and lower housings, and a disc 28 arranged on an underside of the diaphragm 27.

Arranged at a location below the disc 28 is a shaft 29 for transmitting displacement of the diaphragm 27 to the valve element 17. The shaft 29 has an upper portion thereof held by a holder 30 which is arranged in a manner crossing a fluid passage communicating between the refrigerant pipe-connecting holes 14, 15. The holder 30 has a compression coil spring 31 arranged therein for giving a lateral load to an upper end of the shaft 29, such that the compression coil spring 31 controls longitudinal vibration of the shaft 29 which occurs in response to pressure fluctuation of the refrigerant.

Further, in the vicinity of the valve seat 16, a bleed hole 32 is formed in the body 11 in a manner bypassing the valve. The bleed hole 32 is arranged such that a very small amount of refrigerant is permitted to flow even when the valve is fully closed, thereby making it possible to always supply lubricating oil contained in the refrigerant to the compressor 1.

In the expansion valve 6 constructed as above, the power element senses the pressure and temperature of the refrigerant returned from the rear-side evaporator 7 into the refrigerant pipe-connecting hole 14. When the temperature of the refrigerant is high, or when the pressure thereof is low, the power element pushes the valve element 17 in the valve-opening direction, whereas when the temperature of the refrigerant is low, or when the pressure thereof is high, the power element allows the valve element 17 to move in the valve-closing direction, whereby the valve travel is controlled.

The refrigerant supplied from the condenser 2 enters the refrigerant pipe-connecting hole 12, and flows into the space accommodating the valve element 17 through the net 21 of the strainer 20. At this time, foreign matter contained in the refrigerant is removed. The refrigerant cleared of the foreign matter is subjected to throttle expansion by passing through the valve whose valve travel is controlled as described above, thereby being changed into low-temperature and low-pressure refrigerant. The low-temperature and low-pressure refrigerant is discharged from the refrigerant pipe-connecting hole 13, and supplied to the rear-side evaporator 7, where the refrigerant is caused to exchanges heat with rear-side cabin air, followed by returning to the refrigerant pipe-connecting hole 14 of the expansion valve 6.

As described hereinabove, according to the present invention, the block-type expansion valve is configured such that the strainer having a hollow cylindrical shape is arranged in a space for introducing high-pressure liquid refrigerant, in a manner surrounding the valve element. Therefore, it is possible to incorporate the strainer within the expansion valve without substantially changing the shape of the body, thereby making it possible to suppress an increase in the manufacturing costs of the expansion valve only to the cost of the strainer.

Since there is no need to attach the strainer to a pipe, it is possible to dispense with a special pipe for mounting the strainer therein, which makes it possible to reduce the manufacturing costs of the system.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An expansion valve of a block type including a power element for sensing a temperature and pressure of refrigerant delivered from an evaporator, and a valve portion containing a valve element in a block-shaped body thereof, characterized by comprising a hollow cylindrical strainer which is mounted in a fluid passage having said valve element arranged therein, in a manner surrounding said valve element, wherein said strainer includes a hollow cylindrical net whose both open ends are reinforced by annular frames, and wherein said annular frames are arranged in contact with said body defining the fluid passage having said valve element arranged therein, such that said net is located in a passage communicating with a refrigerant pipe-connecting hole through which high-pressure refrigerant is introduced.

2. The expansion valve according to claim 1, wherein said annular frames are integrally formed with longitudinal frames for holding said net in a state buried thereunder.

* * * * *